United States Patent [19]

Kume

[11] Patent Number: 4,924,538

[45] Date of Patent: May 15, 1990

[54] APPARATUS FOR CONVEYING INCUMBENT PERSON

[75] Inventor: Masao Kume, Osaka, Japan

[73] Assignees: Agency of Industrial Science & Technology; Ministry of International Trade & Industry, both of Tokyo, Japan

[21] Appl. No.: 313,449

[22] Filed: Feb. 22, 1989

[30] Foreign Application Priority Data

Apr. 27, 1988 [JP] Japan ..... 63-102610

[51] Int. Cl.[5] ..... A61G 7/10

[52] U.S. Cl. ..... 5/81 B; 5/81 C

[58] Field of Search ..... 5/81 R, 81 B, 81 C; 198/321, 750; 414/921

[56] References Cited

U.S. PATENT DOCUMENTS 3,765,037 10/1973 Dunkin ..... 5/81 C
3,854,152 12/1974 Chez ..... 5/81 C
3,978,531 9/1976 Ilon ..... 5/81 R
4,084,275 4/1978 Ilon ..... 5/81 R
4,087,873 5/1978 Ohkawa ..... 5/81 B

*Primary Examiner*—Michael F. Trettel
*Attorney, Agent, or Firm*—Oblon, Spivak, McClelland, Maier & Neustadt

[57] ABSTRACT

An apparatus for conveying incumbent persons comprises a main body and a plurality of loading mechanisms movably supported on the main body for insertion between an incumbent person and a surface on which the person is supported. Each loading mechanism consists of a pipe structure and a bag-like loading sheet which constantly covers the outer surface of the pipe structure and one part of which is contained inside the pipe structure. The loading sheet is paid out from the inside of the pipe structure when the loading mechanism is being inserted between the person and the supporting surface and is drawn back into the inside of the pipe structure when the loading mechanism is being retracted.

1 Claim, 4 Drawing Sheets

APPARATUS FOR CONVEYING INCUMBENT PERSON

BACKGROUND OF THE INVENTION

1. Field of the Invention

This invention relates to an apparatus for conveying an incumbent person, more particularly to an apparatus for conveying a disabled person or an invalid (herein frequently referred to simply as a "person") lying on a bed, operating table, stretcher or the like and unable to stand or walk.

2. Prior Art Statement

For conveying such an incumbent person it is generally necessary to somehow bring a conveyance means near or in contact with the person and then to cause an operating force to act on the person. Conventional methods that are extensions of techniques for transporting heavy loads have been developed for this purpose and involve, for example, using an apparatus resembling a forklift to lift the person together with his bed or using a crane-like device suspended from the ceiling for lifting the person by means of a sling constituted of belts, a net or a sheet. In addition, one particularly excellent method that has been developed involves inserting a loading plate between the person and the supporting surface (e.g. the top of a bed) and then conveying the person on the plate. In this method, the loading plate has belts wound thereon and the belts are paid out synchronously with the movement of the plate, thus eliminating slippage at the plate surfaces in contact with the person and the supporting surface. The principle involved is shown in FIGS. 6(A), (B) and (C). The loading plate 31 is arranged in upper and lower segments which are separated by spacers 32 and respectively have belts 33*a* and 33*b* wound thereon. When moving toward the incumbent person 36 (FIG. 6(A)), the belt 33*a* on the upper segment rotates counterclockwise while the belt 33*b* on the lower segment rotates clockwise. The reference numerals 34 and 35 respectively denote the main body of the apparatus and the support (e.g. bed) on which the person is lying. The upper belt 33*a* moves beneath the person 36 (FIG. 6(B)) and then after the person has been completely loaded on the upper segment of the loading plate 31 as shown in FIG. 6(C) the plate 31 is returned to the main body 34. At this time, the lower belt 33*b* only is rotated counter clockwise so that the person 36 can be conveyed without slippage between the contacting surfaces. A large number of apparatuses for conveying incumbent persons which operate on this principle have been developed. These are described, for example, in U.S. Pat. Nos. 3,947,902, 3,967,328, 4,073,016, 4,077,073 and 4,680,818, U.S. patent application Ser. No. 031,668, and Japanese Patent Publication Nos. 47(1972)-34477, 56(1981)-16659, 56(1981)-24536 and 56(1981)-34298. While all of these relate to belt-type conveyance systems, they propose various systems for driving and controlling the plates and belts. As a system which has actually been marketed there can be mentioned the Full Automatic Stretcher DR-520 sold by Takara Belmont K.K. of Japan.

These systems are capable of conveying a person with relatively small driving power but entail a problem as to safety. As shown in FIG. 7, the loading plate is constituted in two segments and spacers are ordinarily provided between them at their opposite ends. Thus it is not possible to provide belts on the end portions and these portions are used for the provision of a driving means or the like for the loading plate. Therefore, when one of these portions strikes against the person to be conveyed, the person is apt to be injured because of the large amount of friction arising between the end portion and the person. Moreover, where a loading plate of large area is used, it is necessary to provide spacers at several locations. This makes it impossible to use only a single belt and the usual practice is to provide a plurality of belts in parallel. This increases the risk of the person's hair or fingers getting caught under the lateral edge of a belt in the unbelted region between two adjacent belts. It is also undesirable from the point of sanitation since it provides openings into which dirt, loose hairs and the like can be drawn. For avoiding these problems it might be thought advisable to use one of various other conceivable conveyance methods in which the conveyance means is brought in direct contact with the person to be conveyed. However, from the points of safety and of reducing pain and discomfort to the person, the belt system is considered to be the best.

OBJECT AND SUMMARY OF THE INVENTION

The object of this invention is to provide an apparatus for conveying an incumbent person which is superior from the points of safety and sanitation and which enables the person to be conveyed smoothly.

For achieving this object, the present invention provides an apparatus for conveying an incumbent person comprising a main body, a plurality of loading means disposed on the main body, each loading means being constituted of a pipe structure and a loading sheet which constantly covers the outer surface of the pipe structure and has one portion thereof positioned inside the pipe structure, means for extending the loading means for insertion beneath a person to be conveyed and for retracting the means back to the main body after the person has been loaded thereon, means for paying out the loading sheets from the inside of the pipe structures when the loading means are being extended and means for drawing the loading sheets back into the inside of the pipe structures when the loading means are being retracted.

The plurality of loading means are disposed in parallel on the upper surface of the main body and the loading sheets are constituted of a material which is stretchable in the circumferential direction of the pipe structures but is not stretchable in the axial direction thereof. The arrangement is such that the speed at which the loading means are inserted beneath the incumbent person is mechanically matched with the speed at which the loading sheets are paid out. The speed of retraction of the loading means after loading of the person thereon and the speed of drawing in the loading sheet are also matched. After the loading means have been inserted between the person and the supporting surface, the loading sheets are neither paid out nor wound in with respect to the loading means and the person is transferred to the main body of the apparatus while remaining stationary with respect to the loading means. The ends of the loading sheets inside the pipe structures are connected with wires the other ends of which are connected with loading sheet wind-in devices within the main body of the apparatus, whereby appropriate relative motion is realized among the apparatus components.

With this arrangement, in picking up the person, when the loading plate constituted by the plurality of loading means is extended toward the person by a force from an appropriate means applied to brackets provided on the proximal ends of the loading means, wind-in devices are simultaneously rotated to pay out the wires. If at this time, the loading sheet wind-in devices in the main unit to which the ends of the loading sheets are connected are stopped, no slippage will arise between the loading means and the person or between the loading means and the supporting surface because the loading sheets will be paid out from the insides of the pipe structures. Then when the person is conveyed to the main body of the apparatus, the loading means are retracted toward the main body of the apparatus while at the same time the wires are wound in so that the loading sheets are drawn into the pipes, whereby the person can be transferred to the main body of the apparatus as desired.

The above and other features of the present invention will become apparent from the following description made with reference to the drawings.

DETAILED DESCRIPTION OF THE, PREFERRED EMBODIMENT

Figure 1A:
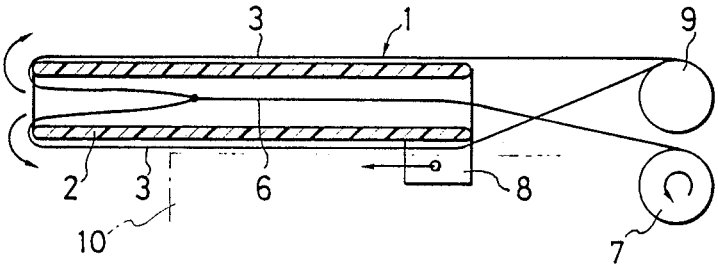
FIG. 1(A) is a longitudinal sectional view of the main portion of the loading means of the apparatus according to this invention
Figure 1B:
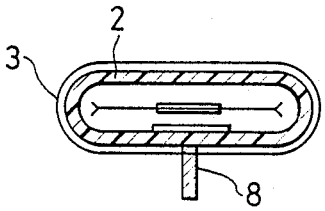
FIG. 1(B) is a cross-sectional view of the main portion of the loading means shown in FIG. 1(B).
Figure 2:
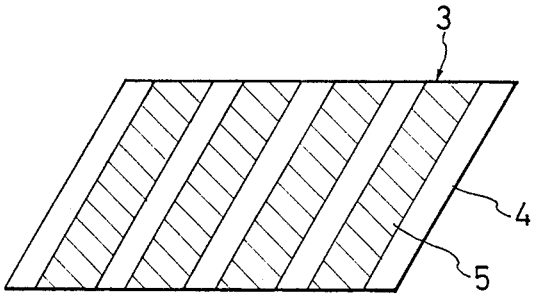
FIG. 2 is a perspective view showing a loading sheet of the loading means as cut in the longitudinal direction and laid flat.
Figure 5:
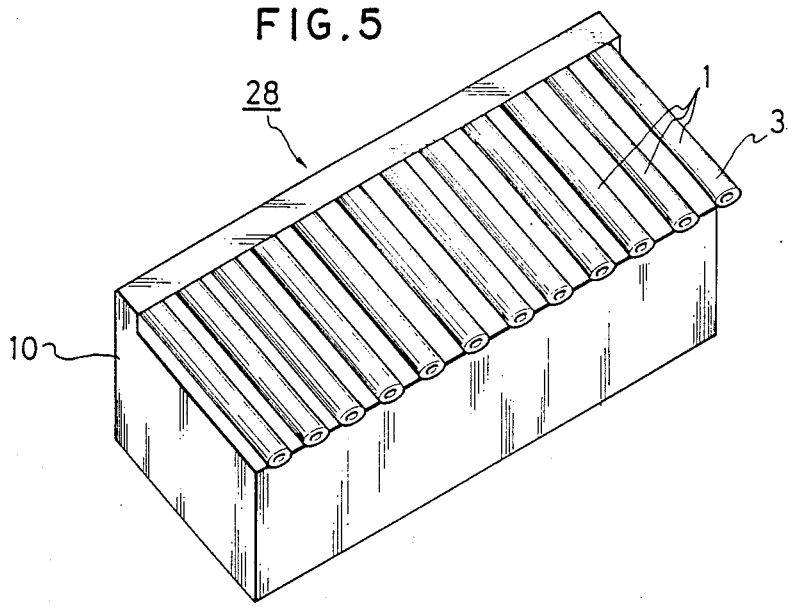
FIG. 5 is a perspective view of the apparatus shown in FIG. 4.
Figure 6A:
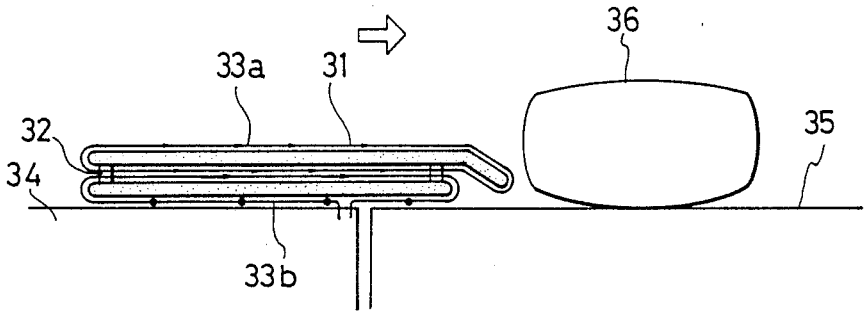
FIG.6(A) PRIOR ART
FIG. 6(A), (B) and (C) are explanatory views showing the principle of belt conveyance employed in a conventional apparatus for conveying incumbent persons.
Figure 6B:
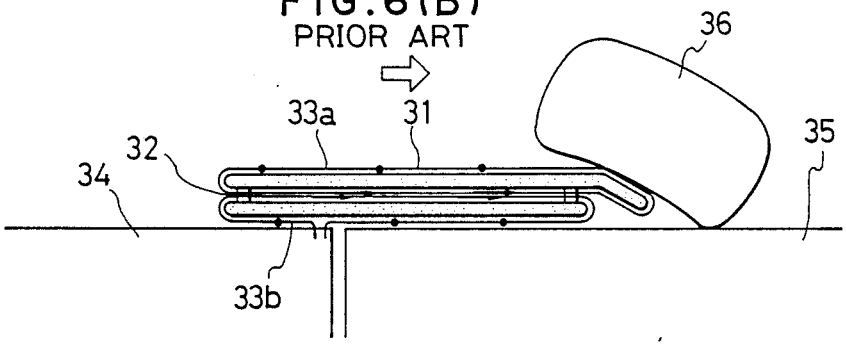
FIG.6(B) PRIOR ART
Figure 6C:
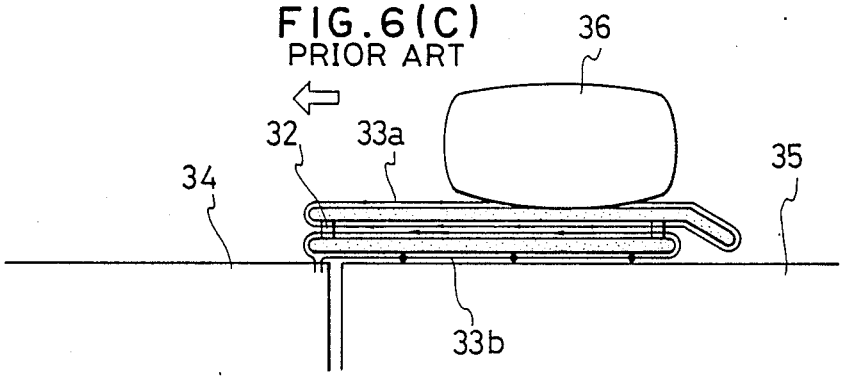
FIG.6(C) PRIOR ART
Figure 7:
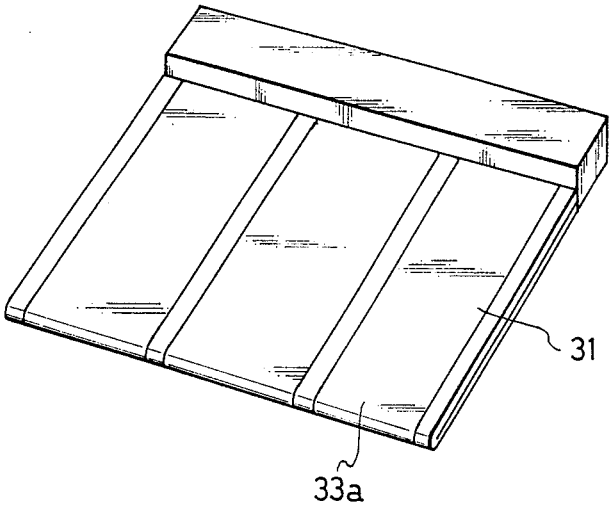
FIG. 7 PRIOR ART
FIG. 7 is a perspective view of the apparatus shown in FIG. 6.

Referring to FIGS. 1(A) and 1(B), reference numeral 1 designates one of a plurality of loading means disposed on the upper surface of a main body 10 of the conveyance apparatus so as to be insertable between the object to be conveyed (ordinarily a person) and the surface supporting the object (ordinarily a bed). Each loading means 1 is constituted of a pipe structure 2 and a loading sheet 3. The loading sheet 3 is in the form of a bag. Part of it is held within the interior of the distal end of the pipe structure 2 and the remainder passes over the exterior of the pipe structure 2 to keep its outer surface covered at all times. The end of the loading sheet 3 within the pipe structure 2 is connected to a wire 6 the other end of which is connected with a wire wind-in device 7 located on the main body 10. The other end of the loading sheet 3 is fixed to a loading sheet wind-in device 9. The pipe structure 2 has a bracket 8 for attachment to a propulsion means on its lower surface and when the pipe structure 2 is driven via this bracket for insertion between the person and the bed, the loading sheet 3 is paid out from the interior of the pipe. On the other hand, when the pipe structure 2 is retracted, the loading sheet 3 is drawn into the pipe. As shown in FIG. 5, a plurality of the loading means 1 are disposed on the upper surface of the main body 10 at intervals small enough to ensure that the person supported thereon will not come in contact with the top of the main body 10. The loading sheets 3 are formed of a material which stretches in the circumferential direction of the pipe but does not stretch in the axial direction thereof. Such a loading sheet 3 can be realized, for example, by an arrangement such as shown in FIG. 2 which shows a number of non-woven cloth strips 5 laminated on a rubber sheet or knit cloth 4. The pipe structures 2 should preferably be made of plastic so as to be light of weight and to minimize the coefficient of friction between the pipe structures and the loading sheets. For enhancing the strength and cushioning effect of the pipe structure 2 it is advantageous to give it an oval cross section with the minor axis oriented vertically. The interval between neighboring pipe structures 2 should be determined with consideration to the pressure (weight) exerted thereon by the person to be conveyed.

The loading sheet 3 is provided with a slit (not shown) at an appropriate location for permitting movement of the bracket 8 and passage of the wire 6.

Figure 4:
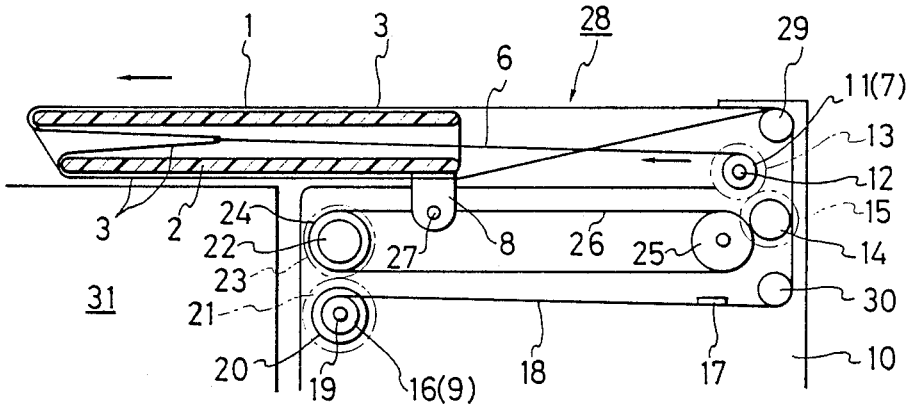
FIG. 4 is a schematic view showing the structure of apparatus according to this invention.

FIG. 4 shows an example of the drive mechanism provided in the main body 10 for operating the loading means described in the foregoing. The wire 6 attached to the end of the loading sheet 3 situated inside of the pipe structure 2 has its other end wound on a pulley 11 constituting the wire wind-in device 7, and a gear 13 fixed on the shaft 12 of the pulley 11 is engaged with and rotated by a gear 15 of a motor 14. After passing over the outer surface of the pipe structure 2, the loading sheet 3 is guided over guide rollers 29, 30 and its other end is connected to a wire 18 by a connector 17. The other end of the wire 18 is wound on a pulley 16 constituting the loading sheet wind-in device 9. The shaft 19 of the pulley 16 is provided with a gear 21 via a clutch 20 which is on only during retraction of the loading means 1. The gear 21 is engaged with a gear 23 of a motor 22 for extending and retracting the loading means 1. A timing belt 26 links a pulley 24 on the shaft of the motor 22 with a timing pulley 25 disposed laterally of the pulley 24, and a shaft 27 fixed on the timing belt 26 is pivotally attached to the bracket 8 projecting from the lower side of the proximal end of the pipe structure 2. In combination, the aforesaid members constitute an apparatus 28 for conveying incumbent persons.

A separate drive mechanism is required for each of the plurality of loading means 1 disposed on the main body 10. However, if the shafts 12,19 and the shafts of the pulleys 24, 25 are extended in length so as to serve in common for all of the drive mechanisms, the number of motors required can be held to two and all of the loading means can be operated in unison.

The operation of the apparatus 28 will now be explained. When a person lying on a bed or other support 31 is to be picked up, the main body 10 is brought near the support 31 as shown in FIG. 4 and the motor 22 for extending/retracting the loading means 1 is operated to cause the timing belts 26 to rotate counterclockwise. The movement of the timing belts 26 is transferred to the loading means 1 via the brackets 8, causing all of the loading means 1 to move simultaneously in the direction of the support 31. The tips of the loading means 1 are thus inserted under the person lying on the support 31.

At this time the motor 14 is operated to pay out the wires 6. On the other hand, the loading sheet wind-in devices 9 are halted so that the loading sheets 3 will be paid out from the interior of the pipe structures 2 and thus eliminate slippage between the loading means 1 and the person and between the loading means 1 and the supporting surface. While the loading means 1 are being extended, the wires 6 are paid out at a speed which is double that of the loading means 1, whereby the speed of insertion of the loading means 1 beneath the person and the speed at which the loading sheets 3 are paid out are mechanically matched. As a result, the loading sheets 3 can be paid out from the interiors of the pipe structures 2 smoothly and the loading means can be inserted beneath the person smoothly. On the other hand, at the time of retracting the loading means 1 toward the main body 10 after the person has been loaded thereon, the wires 6 are drawn in at the same speed as that of the pipe structures 2.

When a person is to be transferred from the loading means onto a bed or other supporting surface, it suffices to carry out the aforesaid operations in reverse. Specifically, the pipe structures 2 and the loading sheets 3 are extended and paid out at the same speed until the person has reached the desired position on the supporting surface. Next, the pipe structures 2 are retracted and simultaneously the wires 6 are wound in at the same speed. As a result, the loading sheets 3 are progressively drawn into the inside of the pipe structures 2 and the person remains on the supporting surface.

Figure 3:
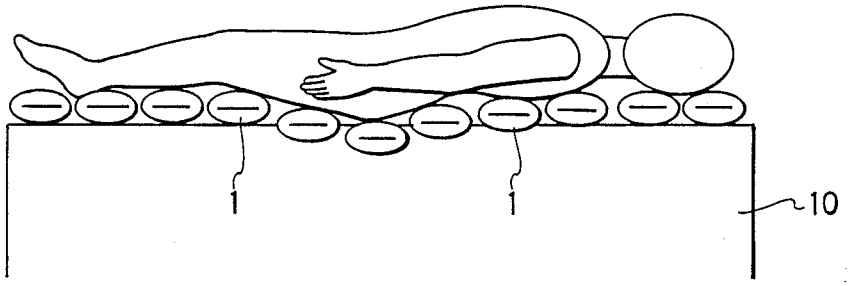
FIG. 3 is a simplified view for explaining the state in which a person is supported on the loading means.

As explained above, in the present invention the pipe structures 2 of the loading means 1 are enclosed by the loading sheets 3 so that there are no gaps at which the person being conveyed can come in contact with the pipe structures 2. This is different from the case of a conveyance plate which consists of a structural member for supporting a person and belts wound thereabout. Further, the pipe structures used in the present invention are advantageous in that they easily flex in the radial direction, providing a cushioning effect for the person being picked up and conveyed. Also, since the pipe structures 2 are driven to extend and retract by a horizontal shaft 27 pivotally attached to the proximal end thereof, the pipe structures are to some degree able to adapt to the contour of the person being conveyed, as shown in FIG. 3.

In the apparatus for conveying an incumbent person according to the present invention, the loading means which apply an operating force with respect to the person to be conveyed are completely covered by the loading sheets. Thus there is no danger of the person's hair or fingers being caught in any part of the apparatus during loading or unloading. Moreover, the person is constantly in contact with loading sheets which are stationary with respect to the person so that the person is not subjected to larger than necessary contact pressures. The apparatus of the invention is thus superior to the conventional conveyance plate type apparatuses in terms of both safety and sanitation. Another advantage of the apparatus according to the invention derives from the fact that the parallelly arranged plurality of loading means (pipe structures) are rotatable by a certain angle about a horizontal axis, which makes it possible for the loading members to enter beneath the person along a line that approximates the contour of the person's body. The cushioning effect of the pipe structures further makes it possible to support and convey the person with optimum comfort.

What is claimed is:

1. An apparatus for conveying incumbent persons comprising:

a main body;

loading means movably supported on said main body for insertion between an incumbent person and a surface on which the person is supported, said loading means comprising a pipe structure and a bag-like loading sheet for constantly covering the outer surface of said pipe structure with one end thereof inserted from a leading end of said bag-like loading sheet to the inside of said pipe structure;

drive means for moving said pipe structure forward and backward;

a first wire having one end thereof connected to said one end of said bag-like loading sheet;

a second wire having one end thereof connected to another end of said bag-like loading sheet; and wire wind-up means connected to other ends of said first and second wires for paying out said first wire when said pipe structure is moved forward and winding up said first wire when said pipe structure is moved backward.

* * * * *